US008019237B2

(12) United States Patent
Bober

(10) Patent No.: US 8,019,237 B2
(45) Date of Patent: Sep. 13, 2011

(54) SYSTEMS AND METHODS FOR MODIFYING FEED TIMING FOR IMAGE RECEIVING MEDIA IN AN IMAGE FORMING DEVICE

(75) Inventor: Henry T. Bober, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 911 days.

(21) Appl. No.: 12/014,922

(22) Filed: Jan. 16, 2008

(65) Prior Publication Data

US 2009/0180787 A1 Jul. 16, 2009

(51) Int. Cl.
*G03G 15/00* (2006.01)
*B65H 5/22* (2006.01)

(52) U.S. Cl. ..... 399/21; 399/399; 399/394; 399/396; 271/3.15

(58) Field of Classification Search ..... 399/16, 399/18, 388, 394, 396
See application file for complete search history.

(56) References Cited

U.S. PATENT DOCUMENTS 5,126,790 A 6/1992 Moore et al.
5,153,663 A 10/1992 Bober et al.
6,032,944 A 3/2000 Lee
6,637,849 B2 10/2003 Maltz
7,052,007 B2 * 5/2006 Yang et al. ..... 271/10.02
7,252,286 B2 8/2007 Bober
7,277,669 B2 10/2007 Howe
7,331,284 B2 * 2/2008 Takahashi ..... 101/118
7,376,364 B2 * 5/2008 Fujita ..... 399/16
7,758,035 B2 * 7/2010 Tamura et al. ..... 270/58.07
2004/0114025 A1 6/2004 Kerxhalli et al.
2005/0269766 A1 12/2005 Bober
2007/0152397 A1 7/2007 Bober, Jr. et al.

* cited by examiner

*Primary Examiner* — Daniel J Colilla
*Assistant Examiner* — Allister Primo
(74) *Attorney, Agent, or Firm* — Oliff & Berridge, PLC

(57) ABSTRACT

A system and method for avoiding paper jams and possible shutdown in an image forming device by automatically executing a series of re-feed cycles for a sheet of image receiving media in a multi pass image forming device. The sheet transport section of the image forming device includes a hold section and a sensor associated with the hold section to provide input to a control unit to execute one or more re-feed cycles based on a failure to sense a sheet of image receiving media in the hold section at an appropriate time in operation of the image forming device. The control unit also controls a hold duration for the sheet of image receiving media at the hold section to synchronize a final feed of the sheet of image receiving media with the operation of the marker unit in the image forming device.

15 Claims, 5 Drawing Sheets

SYSTEMS AND METHODS FOR MODIFYING FEED TIMING FOR IMAGE RECEIVING MEDIA IN AN IMAGE FORMING DEVICE

BACKGROUND

This disclosure is directed to systems and methods that provide improvements in substrate handling in image forming devices.

Printers, copiers and other types of image forming devices have become necessary productivity tools for producing and/or reproducing documents. Such image forming devices include, but are not limited to, desktop copiers, stand-alone copiers, scanners, facsimile machines, photographic copiers and developers, multi-function devices (MFDs), desktop printers, network printers and other like systems capable of producing and/or reproducing image digital data from an original document, data file or the like.

Generally, the process of electrophotographic image forming includes charging a photoconductive member such as a photoconductive belt or drum to a substantially uniform potential to sensitize the photoconductive surface of the photoconductive member. The charged portion of the photoconductive surface is then exposed to a light image from a light source. This light image causes an electrostatic latent image to be formed on the previously uniformly-charged photoconductive surface of the photoconductive member. After the electrostatic latent image is recorded on the photoconductive surface, the latent image is exposed to a marker device or unit that applies charged toner particles onto the latent image on the surface of the photoconductive member according to the charge imparted by the photoconductor. A toner image representing that portion of a final image that is to be formed using a single color of toner is formed on the surface of the photoconductive member. In color reprographic devices the toner image is typically transferred to an intermediate image receiving element. The toner image formed by one or multiple passes of the photoconductive member in contact with the intermediate image receiving element is next transferred onto a suitable image receiving print media such as bond paper. The imaged receiving print media is then exposed to heat and/or pressure to fuse or fix the toner image to the output image receiving media.

As the technology expands, configurations of image forming devices are becoming increasingly more capable, and coincidentally increasingly more complex. Objectives of advances in image forming technologies and devices are to allow for increased reliability, greater image productivity and/or throughput while maintaining image quality and limiting cost. Conventionally, various types of image forming devices transport output image receiving media in linear or straight line paths, particularly between marker modules and fuser modules, in order that the toner deposited on the output image receiving media is not disturbed prior to being ultimately fixed on the output image receiving media. Such capabilities depend on the systems themselves, for example, in the modes of operation of the systems and/or the physical complexity of the systems.

There are many areas regarding output image receiving media substrate handling that lend themselves to optimization within image forming devices as currently configured and operated. An area to be optimized concerns configurations for feeding sheets of image receiving media substrate from a supply of media sheets to an image transfer section in which image forming substances are deposited on the substrate prior to such substance being fixed on the substrate.

Difficulties in individual sheet transport from conventional sheet feeders traditionally represent a significant root cause of print media based system shutdowns or jams in all manner of image forming devices which transport image receiving media upon which hard-copy output images are formed. In many instances, media handling problems occur in the feeder tray holding a supply of print media sheets in the form of a late or slow feed that causes a paper jam or timing error and machine shutdown. When such errors and/or shutdowns occur, significant delays in production from the involved image forming device or devices may ensue before a user may even recognize that a jam and/or shutdown has occurred requiring, in many cases, user intervention to clear the paper jam error and reset/restart the machine. These difficulties become particularly acute when the image forming device is remotely located from any individual operator or user that sends data to the image forming device for production.

SUMMARY

Current embodiments of many image forming devices transport sheets of image receiving media directly from a supply tray or stack of media sheets to a media registration section that leads to the marker unit or image transfer section. A shortfall associated with the current sheet feeding methods involves instances in which individual sheets of image receiving media are not optimally presented to the marker unit or image transfer section on a timing cycle that provides for seamless operation of the image forming device. Specifically, late or slow feed of individual sheets from a print, media supply tray may cause errors in registration of the image on the sheet of output image receiving media and/or paper jam errors.

In view of the above, it would be advantageous to develop improved systems, strategies and methods for print media substrate handling in image forming devices that may detect, for example, a late or slow feed from the print media supply tray or feeder, and automatically take action to mediate the effects of such the late or slow feed in order to avoid a registration error, a jam error and/or a shutdown in the image forming device.

In various exemplary embodiments, the systems and methods according to this disclosure, may detect a late or slow feed in a media registration section before a sheet of image receiving media is committed to marker device or unit and may introduce a timing delay that may delay further transport of the sheet of image receiving media by one or more cycles of the transfer mechanism in order to attempt to automatically allow the sheet to be refed and for the sheet arrival at registration to be synchronized with the next media handling timing cycle. In such an instance, the advantage is that, although the image transfer may be delayed by one or more cycles of the marker device or unit, a shutdown may be avoided as well as the associated printing delay and operator intervention.

In various exemplary embodiments, the systems and methods according to this disclosure, may increase an interval between a successful sheet feed confirmation and an individual sheet of image receiving media being committed to a marker device or unit. It should be recognized that in this regard, in multi-pass color image forming devices, multiple, i.e., typically but not limited to two to four, machine pitches occur between each sheet fed. This characteristic may afford an opportunity for a sheet feeding cycle to be delayed, not for an entire image forming cycle, but for any intervening cycle time. Thus the jam may be avoided with no loss in print or copy productivity.

In embodiments, the systems and methods according to this disclosure may provide an image forming section, in the from of a marker device or unit, that forms a developed image on an intermediate image receiving element, and a sheet transport section that transports the sheet along an image receiving media transport path from a supply tray of sheet media to an image transfer section where the image is transferred from the intermediate image receiving element to the image receiving print media or sheet. The sheet transport section may include a hold section that holds the sheet between the print media sheet supply and the transfer section releasing the sheet to synchronize the arrival of the image receiving print media and the image at the transfer point.

In embodiments, a control unit or step may cause the sheet transport section to perform one or more re-feed cycles, up to a maximum number of possible re-feed cycles, if a media path sensor fails to detect the presence of the sheet in the hold section at the end of an initial feed cycle or at the end of one of the re-feed cycles.

In embodiments, a control unit or step may cause the sheet transport section to perform an initial feed cycle in which the sheet transport section attempts to transport a sheet from the sheet supply to the hold section. The control unit or step may cause the sheet transport section to perform at least one re-feed cycle in which the sheet transport section attempts to transport the sheet from the sheet supply to the hold section if, at the completion of the initial feed cycle, a media path sensor fails to detect the presence of the sheet in the hold section. The control unit or step may cause the sheet transport section to hold a sheet in the hold section for a hold period. The control unit or step may cause the sheet transport section to perform a final feed cycle at the completion of the hold period wherein the transport section transports the sheet from the hold section to the transfer section.

In embodiments, a control unit or control step may calculate a maximum number of possible re-feed cycles based at least on a predetermined duration of the re-feed cycle and/or on a predetermined duration of the final feed cycle, and causes the sheet transport section to perform an additional re-feed cycle up to the total maximum number of possible re-feed cycles if at the end of a re-feed cycle a media path sensor does not detect the presence of the sheet in the hold section.

In embodiments, a control unit or step may calculate a maximum number of possible re-feed cycles based on a predetermined duration of a feed cycle delay between completion of the initial feed cycle and commencement of a subsequent re-feed cycle, and a predetermined duration of a pre-feed delay between completion of a re-feed cycle and commencement of a subsequent pre-feed cycle.

In embodiments, an image forming section may include an exposure section that exposes a surface of a photoreceptor member to form a latent image on the photoreceptor member, and a developing section that develops the latent image. A control unit or step may cause an initial feed cycle to commence prior to commencement of an initial development of the latent image. Alternatively, the control unit or step may cause the initial feed cycle to commence at a time of an initial exposure of the photoreceptor member. A color reprographic device there will be several sets of such components, typically four, one for each color and black.

These and other features and advantages of the disclosed embodiments are described in, or apparent from, the following detailed description of embodiments.

BRIEF DESCRIPTION OF THE DRAWINGS

Exemplary embodiments of disclosed systems and methods for retry feed timing will be described with reference to the drawings, where like numerals represent like parts, and in which.

DETAILED DESCRIPTION OF EMBODIMENTS

The following description of embodiments illustrates examples of systems and methods for modifying a timing cycle for sheet feed in an sheet transport path with regard to feeding individual sheets of image receiving media oil which hard-copy output images are intended to be formed in image forming devices. The following detailed description of various exemplary embodiments of systems and methods for modifying sheet feed timing may refer to one specific type of image forming device, such as, for example, an Image-on-Image electrostatic or xerographic image forming device. The following description may include discussion of various terms relating to image formation in such an image forming device only for the sake of clarity and ease of depiction and/or description. It should be appreciated, however, that although the systems and methods according to this disclosure may be applicable to such a specific application, the depictions and/or descriptions included in this disclosure are not intended to be limited to any specific application, any specific type of image forming device, or any specific image rendering system. It should be understood that any system and/or method for image forming that may advantageously apply the re-feed timing systems and methods according to this disclosure is contemplated.

For example, in referring to image forming devices, as the term is to be interpreted in this disclosure, such devices may include, but are not limited to, copiers, printers, scanners, facsimile machines, xerographic image forming devices, multi-function devices (MFDs), desktop printers, network printers, which include one or more of the functionalities normally associated with the above-enumerated individual image forming devices, and/or any other now known or later-developed systems or devices for producing and/or reproducing hard-copy images on varying types of individual sheets of image receiving media.

Figure 1:
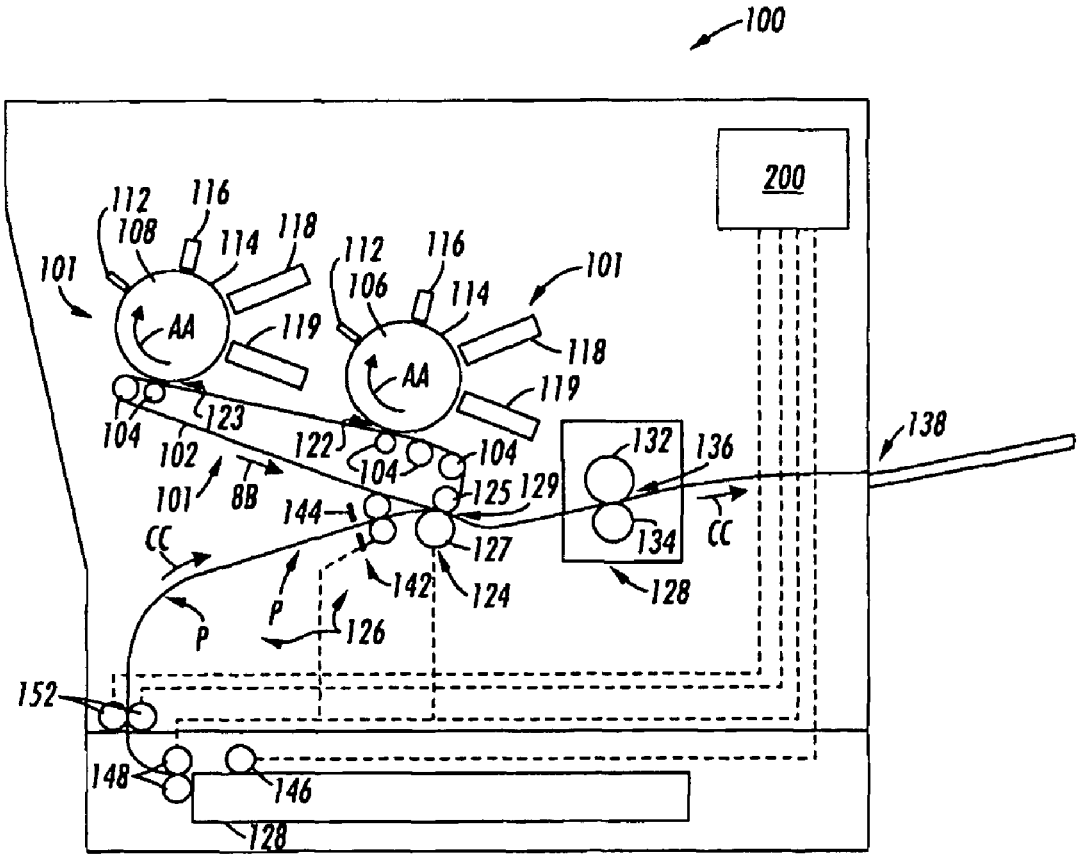
FIG. 1 illustrates a side sectional view of an exemplary embodiment of an image forming device incorporating a system for feed timing according to this disclosure.

FIG. 1 illustrates a side sectional view of an exemplary embodiment of an image forming device 100 incorporating a system for feed timing according to this disclosure. Such an exemplary embodiment may include an Image-on-Image marker device or unit of a type of two pass multi-color printing machine. This image forming device 100 may include an image forming section 101 that forms a developed image on an image transport member, such as, for example, an intermediate transfer belt (ITB) 102 supported by a plurality of rollers or bars 104. The image forming section 101 may include, for example, a pair of photoreceptor members shown in exemplary form as a first photoconductive drum 106 and a second photoconductive drum 108. The exemplary photoconductive drums 106,108 advance in the direction of arrows AA to move successive portions of the external surface of the photoconductive drums 106,108 sequentially beneath various processing stations disposed about their path of movement.

Initially, the surface of exemplary photoconductive drums 106,108 may pass through a charging section 112 and an exposure section 116 of the image forming section 101. The charging section 112 may include a corona generator that charges the exterior surface 114 of the photoconductive drums 106,108 to a relatively high, substantially uniform potential. After the exterior surface 114 of the photoconductive drums 106,108 is charged, the charged portion may advance to an exposure section 116. The exposure section 116 may include a raster output scanner (ROS) or LED Bar, which exposes the charged portion of the exterior surface 114 of the photoconductive drums 106,108 to record a first electrostatic latent image on the photoconductive drums 106,108.

The first electrostatic latent image of the first photoconductive drum 106 may be developed by the first of two developer units 118,119. The first developer unit 118 may develop the image by depositing toner particles, also referred to as toner, of one of selected four colors, in this embodiment the color Yellow, on the first electrostatic latent image. After the Yellow toner image has been developed on the exterior surface 114 of the photoconductive drum, the photoconductive drums 106, 108 continue to advance in the direction AA to a first belt transfer nip 122, where the developed Yellow toner image may be transferred to the ITB 102.

Similarly, the first electrostatic latent image of the second photoconductive drum 108 is developed by its first developer unit 118. The first developer unit 118 of photoconductive drum 108 may develop a latent image formed on the exterior surface 114 of the photoconductive drum 108 by the exposure section 116, in this embodiment using Cyan color toner. After the Cyan toner image has been developed on the exterior surface 114 of the photoconductive drum 108, the photoconductive drum 108 continues to advance to the second belt transfer nip 123, wherein the developed Cyan toner image may be transferred to the ITB 102.

The ITB 102, and the two-color (Y, C) developed image provided on the ITB 102, may advance in the direction BB and makes a second pass through the first and second belt (1st) transfer nips 122,123. When the two-color developed image reaches the first belt (1st) transfer nip 122, a Magenta color image developed using the second developer unit 119 of the first photoconductive drum 106 may be transferred to the ITB 102. When the now three-color developed image reaches the second belt (1st) transfer nip 123, a Black color image developed using the second developer unit 19 of the second photoconductive drum 108 may be transferred to the ITB 102. In this way, a developed, multi-color toner image is formed on the exterior surface of the ITB 102. Thereafter, the ITB 102 advances the multi-color toner image to a transfer section 124, also known as second transfer nip.

At the second transfer section 124, the developed image is transferred onto a sheet of image receiving media, e.g., paper. A sheet transport section 126 transports the sheet along a paper path P from a supply tray of sheet media 128 to the transfer section 124. At transfer section 124, a biased roll transfer device 127 or other similar charge application device acts on the image receiving media and the multi color image, thereby charging the sheet of image receiving media to receive the toner image from the ITB 102. Specifically, this charge transfer device may provide an electrostatic attraction force that attracts the developed multi-color toner image from the exterior surface of the ITB 102 to the sheet of image receiving media. Stripping assist roller 125 may contact the interior surface of the ITB 102 so that the exterior surface of the ITB 102 and a transfer roller 127 form a transfer nip 129 through which the advancing sheet of image receiving media passes. The sheet of image receiving media may be made to move along the paper path P in a direction CC.

The sheet of image receiving media may move along the paper path P from the transfer section 124 to a fusing section 128 that includes a heated fuser roller 132 and a back-up roller 134. The back-up roller 134 may be resiliently urged into engagement with the fuser roller 132 to form a fusing nip 136 through which the sheet passes. In the fusing operation, the toner particles coalesce with one another and bond to the sheet of image receiving media in an output image configuration. After fusing, the finished sheet of image receiving media may be inverted and cycled through a duplex path for second side imaging or it may be discharged to a finishing section for post processing and/or advanced to a catch tray 138 for stacking of output.

It should be appreciated that while toner images and toner particles are disclosed, liquid developer materials employing toner particles in a liquid carrier may also be used. Also, marker devices and/or units that employ other marking materials compatible with specific output image receiving media may be employed.

The transfer section 124 may be employed to transfer the developed image onto a sheet of image receiving media according to the above discussion. A sheet transport section 126 may be employed to transport the sheet along a paper path P from a supply of sheet media 128 to the transfer section 124. The sheet transport section 126 may include a hold section 142 that holds the sheet between the sheet supply or feeder tray 128 and the transfer section 124. The sheet transport section 126 may include one or more of a nudger roller 146, a set of feed rollers 148, and/or a set of take-away rollers 152 that may be operated to move a sheet of image receiving media from the sheet supply tray 128 to the hold section 142. The hold section is be located after the feeder rolls 148 but prior to registration 154. A media path sensor 144 may be positioned along the paper path P proximate to the hold section 142 to detect or otherwise sense the presence of a sheet of image receiving media in or at the hold section 142.

The system may include a controller 200 to control the transport section 126, including, where appropriate, the nudger roller 146, feed rollers 148, and take-away rollers 152, to cause the sheet transport section 126 to perform an initial feed cycle in which the sheet transport section 126 attempts to transport a sheet of image receiving media from the sheet supply tray 128 along the paper path P to the hold section 142. The controller 200 may also control the sheet transport section 126 to perform at least one re-feed cycle in which the sheet transport section 126 may attempt to refeed or re-transport the sheet from the sheet supply tray 128 to the hold section 142 if, at the completion of the initial feed cycle, the media path sensor 144 does not detect the presence of the sheet of image receiving media in the hold section 142. The hold section 142 may hold the sheet for a hold period DH. The controller 200 may cause the sheet transport section 126 to perform a final feed cycle at the completion of the hold period DH in which the sheet transport section 126 transports the sheet from the hold section 142 to the transfer section 124.

In embodiments, the controller 200 may calculate by using, for example, some manner of re-feed cycle determining unit, a maximum number of possible re-feed cycles N based at least on one or more of a predetermined duration of the re-feed cycle DRF and/or a predetermined duration of the final feed cycle DFF. Additional re-feed cycles may sequentially be performed up to the total maximum number of possible re-feed cycles N if, at the end of a re-feed cycle, the sensor 144 does not detect the presence of the sheet in the hold section 142.

In embodiments, the controller 200 may calculate a maximum number of possible re-feed cycles N based additionally on a predetermined duration of a feed cycle delay DRD between completion of an initial feed cycle and commencement of a subsequent re-feed cycle, and a predetermined duration of a pre-feed delay between completion of a re-feed cycle and commencement of a subsequent re-feed cycle.

In embodiments, the image forming section 101 may include an exposure section 116 that exposes an exterior surface 114 of a photoreceptor member 106,108 to form a latent image thereon, and a developing section 118,119 that develops the latent image. The controller 200 may also cause an initial feed cycle to commence prior to the commencement of an initial development of the latent image, or at a time of an initial exposure of the photoreceptor member. In embodiments, the controller 200 may end the initial feed cycle or the re-feed cycle upon detection, by the sensor 144, of the presence of a sheet in the hold section 142.

Figure 2:
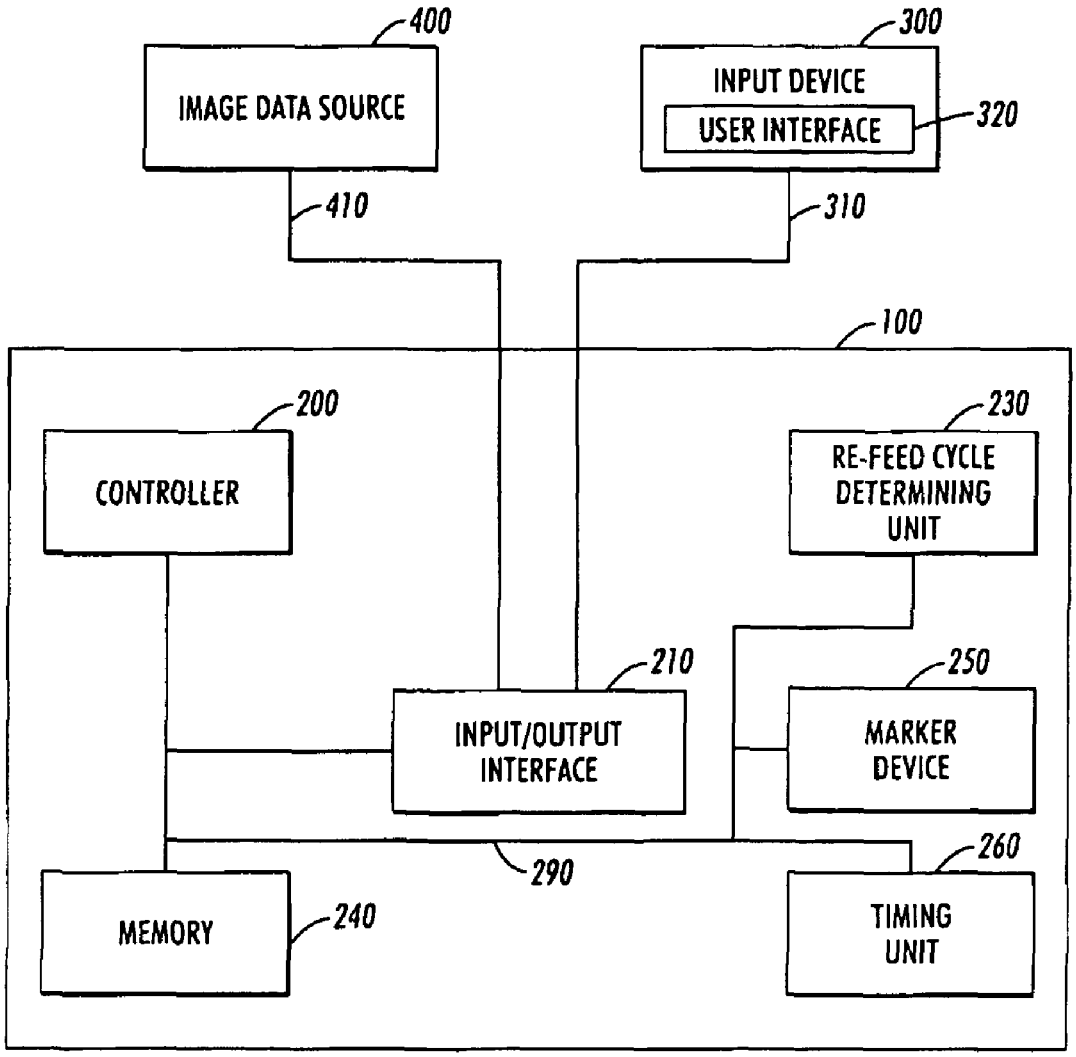
FIG. 2 illustrates a functional block diagram of an exemplary embodiment of a system for implementing feed timing according to this disclosure.

FIG. 2 illustrates a functional block diagram of an exemplary embodiment of a system 100 for implementing feed timing according to this disclosure. The system 100 may be connected to an input device 300 via a link 310, which may be one or more of a wired, wireless or optical link, and an input/output interface 210. The input device 300, which may include a user interface 320, may be used to input various information that may be used to implement operations of the system 100, such as user instructions. The input device 300 and/or user interface 320 may include one or more of a mouse, a keyboard, a touch-screen input device, a voice recognition-based input device, and/or any other known or later developed device usable for inputting information. In some embodiments, the input device 300 and/or user interface 320 may be part of the system 100 itself, and, may be connected directly to the bus 290 and/or controller 200 of the system 100, without being connected via an input/output interface, such as the input/output interface 210.

The system 100 may be connected to an image data source 400 via a link 410 and via the input/output interface 210. The image data source 400 may be one or more of a digital camera, a scanner, or a locally or remotely located computer, which may include a word processing program and/or document creation program or the like, or any other known or later developed device that is capable of generating electronic image data. Similarly, the image data source 400 can be any suitable device that stores and/or transmits electronic image data, such as a client or a server of a network. The link 410 may thus be or include any known or later developed wired, wireless or optical device for transmitting the electronic image data from the image data source 400 to the system 100.

Further, it should be appreciated that either or both of the links 310 and 410 may be a wired, wireless or optical link to a network (not shown). The network may be a local area network, a wide area network, an intranet, the Internet or any other distributed processing and storage network.

The system 100 may include a controller 200, a re-feed cycle determining unit 230, a memory 240, a marker device 250, and a timing unit 260, all or some of which may be interconnected by a data/control bus 290.

The controller 200 may control operations of other components of the system 100, perform calculations and execute programs for implementing the processes of the system 100 and/or individual components of the system 100. The controller 200 may control the flow of data between other components of the system 100 as needed.

The memory 240 may serve as a buffer for information coming into or going out of the system 100, may store programs and/or data for implementing the functions of the system 100, such as a program for causing a computer to implement the exemplary methods described below, and/or may store data at various stages of processing. Furthermore, it should be appreciated that the memory 240, while depicted as a single entity, may actually be distributed. Alterable portions of the memory 240 may, in various exemplary embodiments, be implemented using static or dynamic RAM. However, the memory 240 can also be implemented using a floppy disk and disk drive, a writeable optical disk and disk drive, a hard drive, flash memory or the like. The generally static portions of the memory 240 may, in various exemplary embodiments, be implemented using ROM. The static portions may also be implemented using other non-volatile memory, such as PROM, EPROM, EEPROM, an optical ROM disk, such as a CD-ROM or DVD-ROM, and disk drive, flash memory or other alterable memory, as indicated above, or the like.

The marker device 250 may be a xerographic marker device, an inkjet marker device, or any other type of marker device. The marker device 250 may be used to deposit image forming substances on individual sheets of image receiving media such as, for example, images of documents or other electronic information that may have been created, copied, or otherwise generated by a user, based on incoming data from the image data source 400.

Referring now to Tables 1 and 2, details are provided of a timing scheme for a first exemplary embodiment (Example 1) of the system 100 included in, for example, a multi-pass color image forming device.

TABLE 1

| Example 1 Timing Data |
|---|
| DIF (Duration of Initial Feed Cycle) = TIFF − TIFS = 1000 msec |
| DRF (Duration of Retry Feed Cycle) = TRF(N) − TRS(N) = 1000 msec |
| DRD (Duration of Retry Feed Delay) = TRDF − TRDS = 475 msec |
| DFF (Duration of Final Feed, Hold to Registration) = TM − THF = 250 msec |
| DH (Duration of Media Hold) = THF − THS = 750 msec |
| DIE (Duration of Image Exposure) = TEF − TES = 540 msec |
| DBT (Duration of Belt Transfer) = TBF − TBS = 540 msec |
| DBC (Duration of Belt Cycle) = TBS12 − TBS11 = 1475 msec |
| DM (Duration from Initial Image Exposure to Media ($2^{nd}$) Transfer) = TM − TES11 = 3033 msec |
| DB (Duration from First Belt ($1^{st}$) Transfer to Second Belt ($2^{nd}$) Transfer) = TBS21 − TBS11 = 443 msec |
| DET (Duration from Initial Exposure to Initial Belt ($1^{st}$) Transfer) = TBS11 − TES11 = 308 msec |
| DBM (Duration from Second Belt ($1^{st}$) Transfer to Media ($2^{nd}$) Transfer) = TM − TBS22 = 808 msec |

TABLE 2

| Example 1 Data |
|---|
| LB (Intermediate Transfer Belt Length) = 590 mm |
| D (Photoconductive Drum Diameter) = 84 mm |
| V (ITB Speed) = 400 mm/sec |
| LM (Length of Media Sheet) = 216 mm (8.5 inches) |
| θ (Drum Angle Between Exposure and Belt Transfer) = 168° |
| F (Distance from Feed Nip to Registration Nip) = 400 mm |
| R (Distance from Registration Nip to Second Transfer Nip) = 100 mm |
| A (Distance from First Belt ($1^{st}$) Transfer to Second Belt ($1^{st}$) Transfer) = 177 mm |
| B (Distance from Second Belt ($1^{st}$) Transfer to Media ($2^{nd}$) Transfer Nip) = 323 mm |

Figure 3:
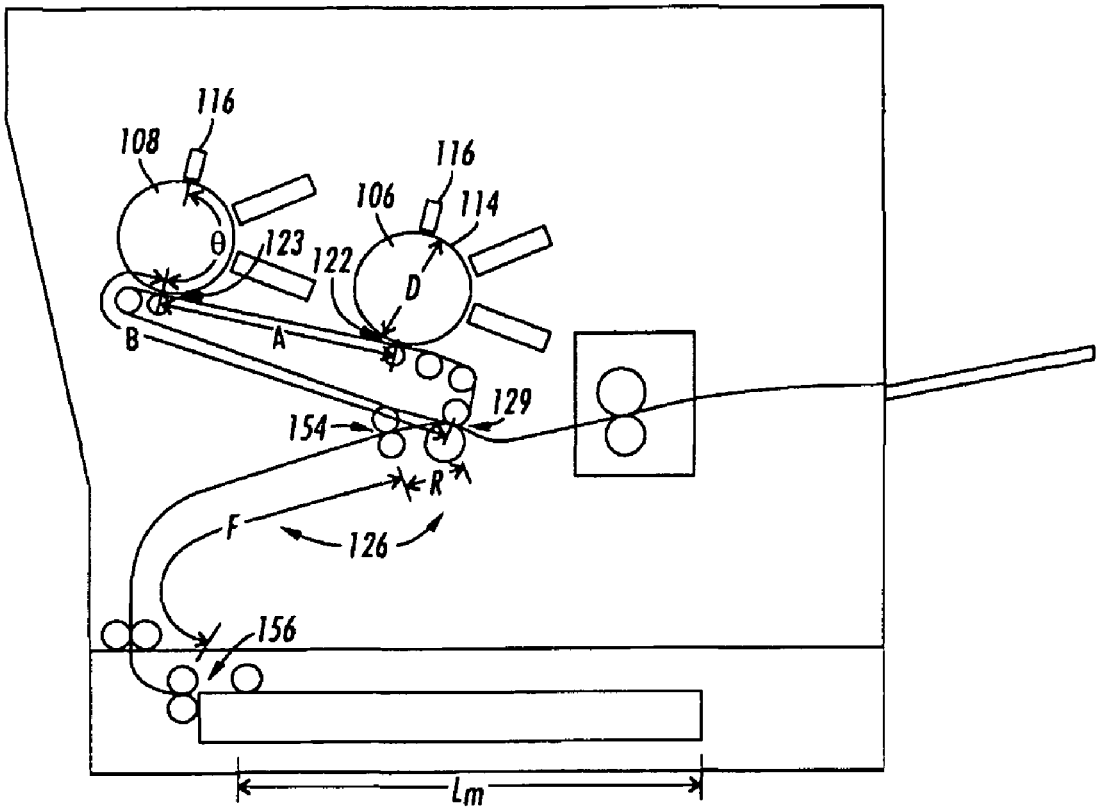
FIG. 3 illustrates a side sectional view of a second exemplary embodiment of an image forming device incorporating a system for feed timing according to this disclosure.

FIG. 3 illustrates a side sectional view of a second exemplary embodiment of an image forming device incorporating a system for feed timing according to this disclosure. With reference to FIG. 3, the depicted exemplary embodiment provides an intermediate transfer belt (ITB) 102 having a length LB of 590 mm that travels at a belt speed V of 400 mm/sec. The pair of photoconductive drums 106,108 have a diameter D of 84 mm and are spaced apart so that the distance A between the first belt (1st) transfer nip 122 and the second belt (1st) transfer nip 123 is 177 mm. The drum angle between the respective exposure units 116 and belt transfer nips 122, 123 is 168 degrees. The distance B that ITB 102 travels between the second belt (1st) transfer nip 123 and the media (2nd) transfer nip 129 is 323 mm. The sheet transport section 126 transports sheets having a length LM of 216 mm (for 8.5 inches media, for example). The distance F from a feed nip 156 to a registration nip 154 in the hold section 142 is 400 mm. The distance R from the registration nip 154 to the media transfer nip 129 is 100 mm.

Figure 4:
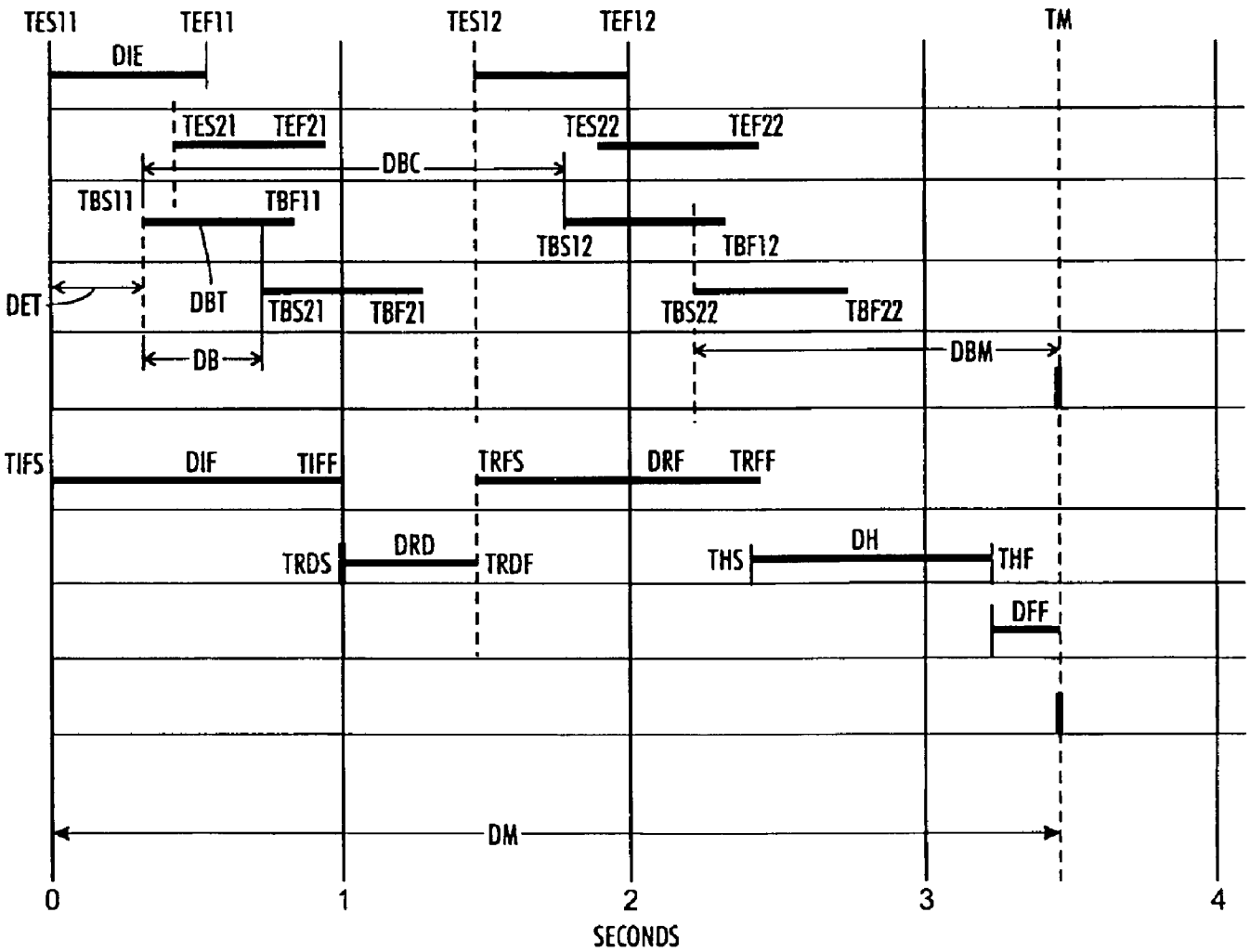
FIG. 4 illustrates an exemplary timing chart for a feed timing system and method according to this disclosure.

FIG. 4 illustrates an exemplary timing chart for a feed timing system and method according to this disclosure. With reference to the timing chart provided in FIG. 4, the exemplary embodiment depicted in FIG. 3 may be operated so that a duration DIF of an initial feed cycle from a start time TIFS of the initial feed cycle to a completion time TIFF of the initial feed cycle may be in a range of approximately 1000 msec. The duration DRF of each of N re-feed cycles, N being a maximum number of possible re-feed cycles, from a start time TRS(N) of the re-feed cycle to a completion time TRF (N) may also be in a range of approximately 1000 msec. The duration DRD of a retry feed delay from a start time TRDS of the retry feed delay to a completion time TRDF of the retry feed delay may be in a range of approximately 475 msec for a product of this speed [such as, for example, 20 color prints/min]. The duration DFF of a final feed cycle from a start time of the final feed cycle THF, for example, a completion time of a media hold cycle, to a completion time of the final feed cycle TM, for example, a start time of a media transfer, may be in a range of approximately 250 msec. A duration DH for holding the media in the hold section 142 from a start time THS of a media hold to a completion time THF of the media hold may be in a range of approximately 750 msec.

The image forming section 101 may be operated so that a duration DIE of image exposure from a start time TES of the image exposure to a completion time of the image exposure TEF may be in a range of 540 msec, which may equal a duration DBT of image transfer from the photoconductive drums 106,108 to the ITB 102, for example, from a start time TBS of the belt transfer to a completion time TBF of the belt transfer. A duration DBC for the ITB 102 to cycle, such as, from a start time of a first image transfer TBS11 at the first belt (1st) transfer nip 122 to a start time of a second image transfer TBS12 at the second belt (1st) transfer nip 123, may be in a range of approximately 1475 msec. The duration DB from a time of an initial transfer at the first belt (1st) transfer nip 122 TBS11 to an initial transfer at the second belt (1st) transfer nip 123 TBS21 may be in a range of approximately 443 msec. A duration DET of a time of initial image exposure of one or more of the photoconductive drums 106,108, such as TES11, to a start time of the transfer of the image from the respective drums to the ITB 102, such as TBS11, may be in a range of approximately 308 msec. A duration DBM for the ITB 102 to travel from the second belt (1st) transfer nip 123 to the media (2nd) transfer nip 129 may be in a range of approximately 808 msec. A duration DM from a time TES11 of an initial image exposure of the exposure unit 116 of the photoconductive drum 106 to the start time TM of the media transfer at the transfer nip 129, the ITB 102 having completed two passes through each belt transfer nip 122 and 123, may be in a range of approximately 3033 msec.

Figure 5:
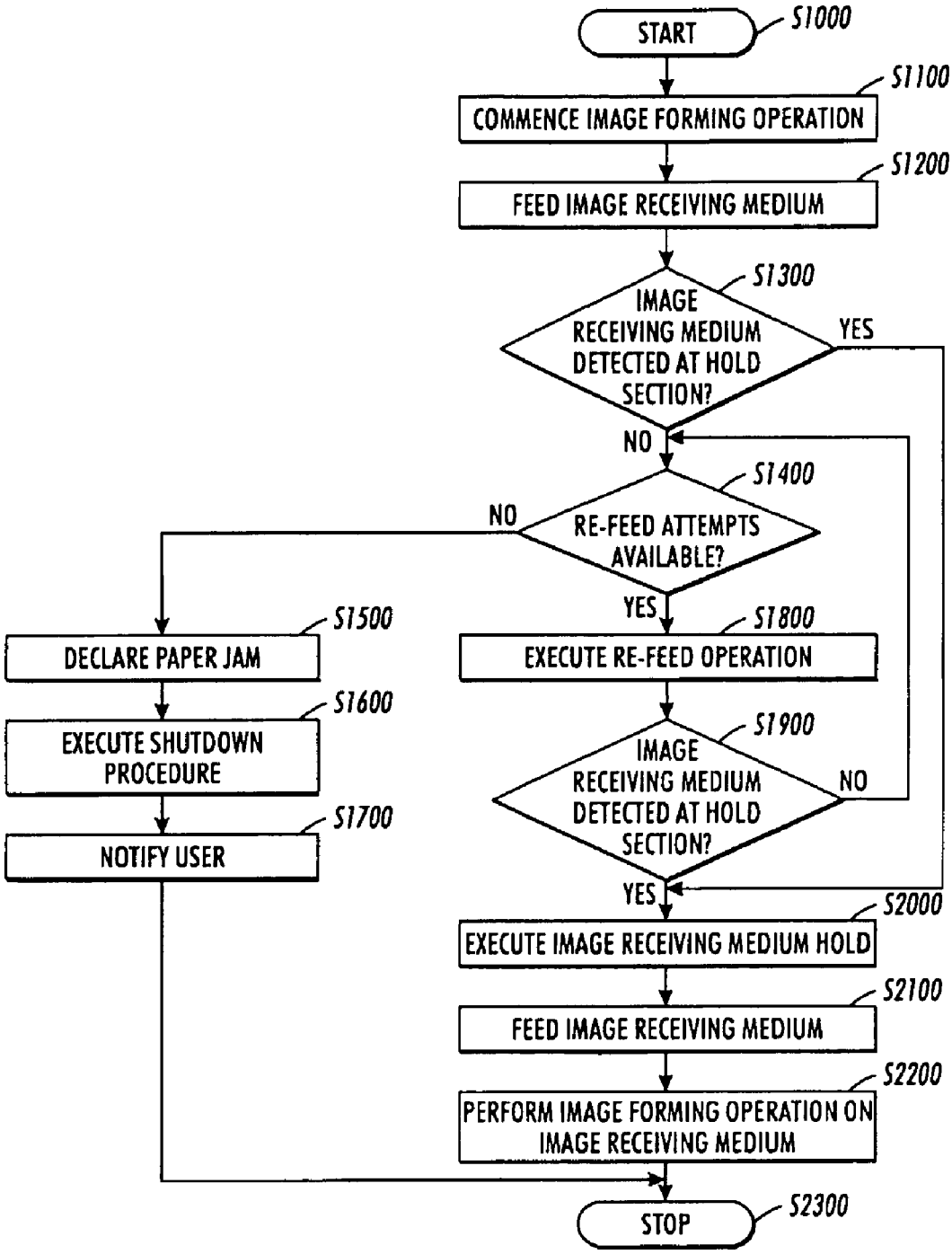
FIG. 5 illustrates a flowchart of an exemplary method for operating a system to adjust feed timing of image receiving media according to this disclosure.

FIG. 5 illustrates a flowchart of an exemplary method for operating a system to adjust feed timing of image receiving media according to this disclosure. Operation of the method commences at step S1000, and proceeds to step S1100.

In step S1100, an image forming operation may be commenced. Operation of the method proceeds to step S1200.

In step S1200, a sheet of image receiving media is fed along, for example, an image receiving media transport path. Operation of the method proceeds to step S1300.

Step S1300 is a determination step for determining whether a sheet of image receiving media is detected at a hold section in the image forming device.

If in step S1300, a sheet of image receiving media is detected at the hold section, operation of the method proceeds to step S2000.

If in step S1300, a sheet of image receiving media is not detected at the hold section, operation of the method proceeds to step S1400.

Step S1400 is a determination step in which, depending on the image forming device within which a system for executing the described method is installed, there is an opportunity to attempt a re-feed timing adjustment, such as, for example, between image forming cycles of the marker device and/or unit in the image forming device.

If in step S1400, it is determined that no re-feed attempts are available, then the system may operate essentially as a conventional system and operation of the method may proceed to step S1500.

In step S1500, a paper jam may be declared. Such declaration may be made by any means known to those of ordinary skill in the art. Operation of the method may proceed to step S1600.

In step S1600, the image forming device may execute a shutdown procedure in response to the paper jam. Operation of the method may proceed to step S1700.

In step S1700, a user may be notified by any available means of either the declaration of a paper jam and/or execution of a shutdown procedure in the image forming device. Operation of the method proceeds to step S2300 where operation of the method ceases.

If in step S1400, re-feed attempts are available, operation of the method proceeds to step S1800.

It should be noted that re-feed attempts may be available because the system represents a two, four or other multi-pass system for providing image-on-image transfer to the image receiving media. In such an instance, re-feed may be attempted between each of, or one or more of, the image transfer steps in the image forming device based on a specific timing of those image forming steps in, for example, a marker device and/or unit within the image forming device.

In step S1800, a re-feed operation may be executed by modifying a timing of the image forming operation such that the image forming operation is interrupted while the image forming device attempts to re-feed a sheet of image receiving media in accordance with the detailed discussion outlined above. Variations in the timing algorithm may be introduced to provide an opportunity for a sheet of image receiving media to be re-fed and the image forming operation allowed to proceed in accordance with the revised timing. Operation of the method proceeds to step S1900.

Step S1900, like step S1300, is a determination step for determining whether a sheet of image receiving media is detected at a hold section.

If in step S1900, a sheet of image receiving media, after execution of a re-feed operation, is not detected at a hold section, operation of the method may revert to step S1400 where a determination may be made regarding whether additional re-feed attempts may be available in the image forming device.

If in step S1900, a sheet of image receiving media is detected at the hold section, as was the situation in step S1300 above, operation of the method proceeds to step S2000.

In step S2000, an image receiving media hold may be executed for a specified duration in order to ensure synchronization between further feeding of the sheet of image receiving media to, for example, the marker device and/or unit within the image forming device in order to prevent paper jams and associated shutdown procedures within the image forming device, or otherwise to attempt to synchronize registration of, for example, an image-on-image transfer according to a modified timing scheme. Such an image receiving media hold may be undertaken for a specified duration, or may be undertaken in order to synchronize the passage of the sheet of image receiving media appropriately. Operation of the method proceeds to step S2100.

In step S2100, with an appropriate sheet of image receiving media having achieved positioning at a hold section, whether delayed there based on any re-feed operation or image receiving media hold, or otherwise having achieved positioning at the hold section based on clear feed, the sheet of image receiving media is further fed to the image forming processor such as, for example, to the marker device and/or unit within the image forming device. Operation of the method proceeds to step S2200.

In step S2200, image forming operations of depositing, for example, image forming substances on the sheet of image receiving media are completed. Operation of the method proceeds to step S2300 where operation of the method ceases.

It should be appreciated that the image forming operation may require one or more cycles of the marker device and/or unit to accomplish image forming upon the sheet of image receiving media.

In embodiments, a method is provided for transporting a sheet of image receiving media along a transport path of an image forming device. The method may include performing an initial feed cycle wherein a sheet transport section attempts to transport the sheet from a sheet supply to a hold section that holds the sheet between the sheet supply and the transfer section or a marker device or unit. In embodiments, the method may include sensing the presence of the sheet in the hold section, and determining at the completion of the initial feed cycle whether or not a sensor detects the presence of the sheet in the hold section.

If the sensor does not detect the presence of the sheet in the hold section, the method may perform at least one re-feed cycle wherein the sheet transport section attempts to transport the sheet from the sheet supply to the hold section. The sheet may be held in the hold section for a hold period if the sensor detects the presence of the sheet in the hold section. The method may also include performing a final feed cycle at the completion of the hold period wherein the sheet transport section transports the sheet from the hold section to the transfer section and/or to the marker device or unit.

In embodiments, the method may include calculating a maximum number of possible re-feed cycles based at least on a predetermined duration of the re-feed cycle and on a predetermined duration of the final feed cycle, and performing additional re-feed cycles up to but not exceeding the total maximum number of possible re-feed cycles if, at the end of a completed re-feed cycle, the sensor does not detect the presence of the sheet in the hold section. The calculation of the maximum number of possible re-feed cycles may be additionally based on a predetermined duration of a feed cycle delay between the completion of the initial feed cycle and the commencement of a subsequent re-feed cycle, and a predetermined duration of a re-feed delay between the completion of a re-feed cycle and the commencement of a subsequent re-feed cycle.

In embodiments, a method of transporting a sheet is provided wherein the initial feed cycle, or the re-feed cycle, terminates upon the detection by the sensor of the presence of the sheet in the hold section. The image forming device may include an exposure section that exposes a surface of a photoreceptor member to form a latent image thereon, a developing section that develops the latent image, and the initial feed cycle may commence prior to a commencement of an initial development of the latent image. The initial feed cycle may commence at a time of an initial exposure of the photoreceptor member.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art and are intended to be encompassed by the following claims.

What is claimed is:

1. A substrate handling system, comprising:

a sheet transport section that transports a sheet of image receiving media along a path from a sheet supply, the sheet transport section including a hold section that holds the sheet of image receiving media at a position in the sheet transport section after the sheet supply;

a sensor that senses the presence of the sheet of image receiving media at the hold section;

a control unit that (1) causes the sheet transport section to perform an initial feed cycle to transport the sheet of image receiving media from the sheet supply to the hold section, (2) receives an input from the sensor regarding whether the sheet of image receiving media is present at the hold section at the completion of the initial feed cycle, and (3) causes the sheet transport section to perform at least one re-feed cycle when the input indicates that the sheet of image receiving media is not present at the hold section at the completion of the initial feed cycle; and a marker unit that deposits an image forming material on the sheet of image receiving media, wherein the control unit calculates a maximum number of possible re-feed cycles based on at least one operating parameter of the marker unit, and the marker unit deposits a plurality of image forming materials separately on the sheet of image receiving media, each of the plurality of image forming materials being deposited individually as an individual sub-operation performed by the marker unit, and the calculated maximum number of possible re-feed cycles corresponds to the number of individual sub-operations performed by the marker unit.

2. The system of claim 1, wherein the control unit causes the sheet transport section to perform an additional re-feed cycle up to the calculated maximum number of possible re-feed cycles if at the end of the at least one re-feed cycle the input indicates that the sheet of image receiving media is not present at the hold section.

3. The system of claim 1, wherein the control unit (1) causes the sheet transport section to hold the sheet of image receiving media at the hold section for a hold period when the input indicates that the sheet of image receiving media is present at the hold section, and (2) causes the sheet transport section to perform a final feed cycle that transports the sheet of image receiving media to the marker unit.

4. The system of claim 3, wherein the hold period is of a duration that synchronizes the final feed cycle with operation of the marker unit.

5. The system of claim 3, wherein the control unit calculates a maximum number of possible re-feed cycles based on at least one of a duration of the at least one re-feed cycle, a duration of the final feed cycle, a duration of a feed cycle delay between the completion of the initial feed cycle and the commencement of a subsequent re-feed cycle, or a duration of a pre-feed delay between the completion of a re-feed cycle and the commencement of a subsequent re-feed cycle.

6. The system of claim 1, wherein the control unit terminates the initial feed cycle or the at least one re-feed cycle when the input indicates that the sheet of image receiving media is present at the hold section

7. An image forming device including the system of claim 1.

8. A xerographic image forming device including the system of claim 1.

9. A method of transporting a sheet of image receiving media along a paper path, comprising:

performing an initial feed cycle wherein a sheet transport section transports a sheet of image receiving media from a sheet supply to a hold section in the sheet transport section;

sensing a presence of the sheet of image receiving media at the hold section, the sensing occurring via a sensor associated with the hold section;

receiving an input from the sensor at the completion of the initial feed cycle whether the sheet of image receiving media is present at the hold section;

performing at least one re-feed cycle of the sheet transport section when the received input indicates that the sheet of image receiving media is not present at the hold section; and calculating a maximum number of possible re-feed cycles based on at least one operating parameter of a marker unit that deposits an image forming material on the sheet of image receiving media, wherein the marker unit deposits a plurality of image forming materials separately on the sheet of image receiving media, each of the plurality of image forming materials being deposited individually as an individual sub-operation performed by the marker unit, and the calculated maximum number of possible re-feed cycles corresponds to the number of individual sub-operations performed by the marker unit.

10. The method of claim 9, further comprising performing at least one additional re-feed cycle up to the calculated maximum number of possible re-feed cycles if at the end of the at least one re-feed cycle the input indicates that the sheet of image receiving media is not present at the hold section.

11. The method of claim 9, further comprising:

holding the sheet of image receiving media at the hold section for a hold period when the input indicates that the sheet of image receiving media is present at the hold section; and performing a final feed cycle at the completion of the hold period that transports the sheet of image receiving media from the hold section to the marker unit.

12. The method of claim 11, wherein the hold period is of a duration that synchronizes the final feed cycle with operation of the marker unit.

13. The method of claim 11, further comprising:

calculating a maximum number of possible re-feed cycles based on at least one of a duration of the re-feed cycle, a duration of the final feed cycle, a duration of a feed cycle delay between the completion of the initial feed cycle and the commencement of a subsequent re-feed cycle, or a duration of a pre-feed delay between the completion of a re-feed cycle and the commencement of a subsequent re-feed cycle.

14. The method of claim 9, further comprising terminating the initial feed cycle or the at least one re-feed cycle when the input indicates that the sheet of image receiving media is present at the hold section.

15. A non-transitory computer readable storage medium on which is stored a program for causing a computer associated with an image forming device to execute the method of claim 9.

* * * * *